US008406678B2

(12) United States Patent
Shouno et al.

(10) Patent No.: US 8,406,678 B2
(45) Date of Patent: Mar. 26, 2013

(54) CLEANING ROLLER FOR CLEANING IMAGE BEARING MEMBER

(75) Inventors: Junpei Shouno, Kawasaki (JP); Yohei Nakade, Okazaki (JP); Ichiro Demizu, Toyonaka (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 715 days.

(21) Appl. No.: 12/481,790

(22) Filed: Jun. 10, 2009

(65) Prior Publication Data

US 2009/0311003 A1 Dec. 17, 2009

(30) Foreign Application Priority Data

Jun. 13, 2008 (JP) ..... 2008-155243

(51) Int. Cl.
*G03G 21/00* (2006.01)

(52) U.S. Cl. ..... 399/357

(58) Field of Classification Search ..... 399/101, 399/357

See application file for complete search history.

(56) References Cited

U.S. PATENT DOCUMENTS

| | | | | |
|---|---|---|---|---|
| 8,160,470 | B2 * | 4/2012 | Shouno et al. | 399/100 |
| 2002/0009316 | A1 * | 1/2002 | Endo et al. | 399/349 |
| 2002/0197082 | A1 * | 12/2002 | Hosokawa et al. | 399/176 |
| 2004/0213598 | A1 * | 10/2004 | Mori et al. | 399/101 |
| 2005/0180790 | A1 * | 8/2005 | Mizumoto | 399/357 |
| 2007/0092289 | A1 * | 4/2007 | Nagamori et al. | 399/100 |
| 2007/0104504 | A1 * | 5/2007 | Terai et al. | 399/100 |
| 2008/0019729 | A1 * | 1/2008 | Hoshio et al. | 399/100 |
| 2009/0169237 | A1 * | 7/2009 | Shouno et al. | 399/100 |
| 2010/0150601 | A1 * | 6/2010 | Sano et al. | 399/101 |

FOREIGN PATENT DOCUMENTS

| | | | |
|---|---|---|---|
| JP | 8-272228 | | 10/1996 |
| JP | 11-38777 | A | 2/1999 |
| JP | 2000-320536 | | 11/2000 |
| JP | 2002-82537 | A | 3/2002 |
| JP | 2005-49449 | A | 2/2005 |
| JP | 2006330613 | A * | 12/2006 |
| JP | 2007-079111 | | 3/2007 |
| JP | 2008-116834 | | 5/2008 |

OTHER PUBLICATIONS

Machine translation of Echigo (JP 2002-082,537 A) Publication date Mar. 22, 2002.*

Machine translation of Yamamoto et al. (JP 2006-330,613 A) Publication date Dec. 7, 2006.*

Notice of Reasons for Refusal issued on Apr. 13, 2010 in corresponding Japanese Patent Application No. 2008-155243, and English translation thereof.

* cited by examiner

*Primary Examiner* — Walter L Lindsay, Jr.
*Assistant Examiner* — Rodney Bonnette
(74) *Attorney, Agent, or Firm* — Buchanan Ingersoll & Rooney PC

(57) ABSTRACT

A cleaning roller has a core and a polyurethane foam layer covering the core to form a peripheral surface of the cleaning roller adapted to be in contact with a peripheral surface of the toner image bearing member. The polyurethane foam is designed so that the number of cell per inch thereof is 30 or more and 60 or less and an open ratio of cell walls thereof is 3% or more and 50% or less.

17 Claims, 5 Drawing Sheets

FIG. 3
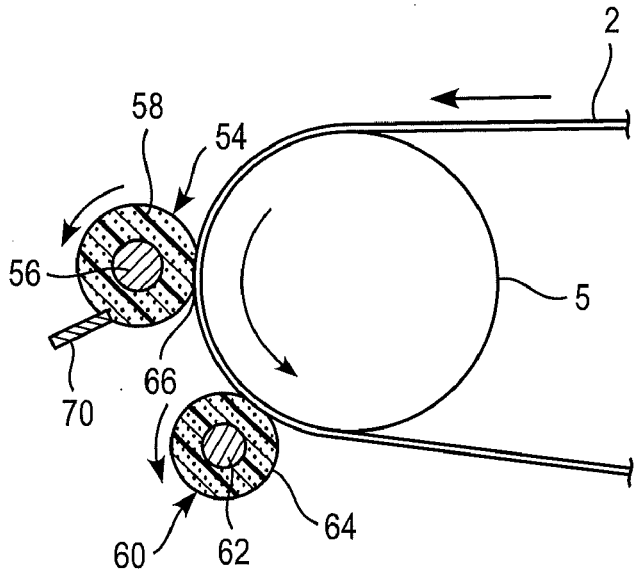
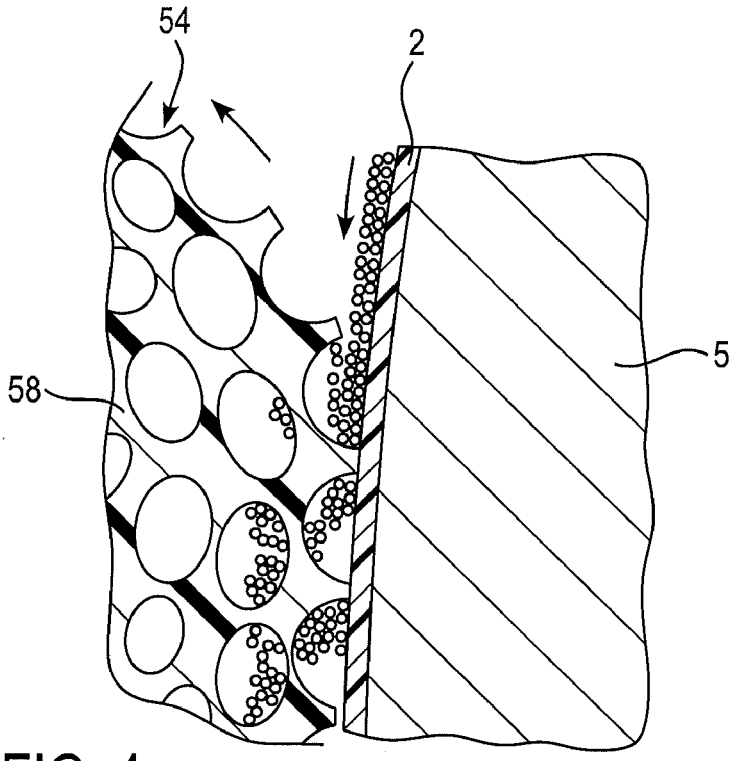
FIG. 4

CLEANING ROLLER FOR CLEANING IMAGE BEARING MEMBER

RELATED APPLICATION

The present application is based upon the Japanese Patent Application No. 2008-155243, the entire disclosure thereof being incorporated herein by reference.

FIELD OF THE INVENTION

The present invention relates to a cleaning roller for cleaning an image bearing member in an image forming apparatus. The present invention also relates to an image forming apparatus using the cleaning roller.

BACKGROUND OF THE INVENTION

A typical electrophotographic image forming apparatus has an electrostatic latent image bearing member for bearing electrostatic latent images thereon. In the image forming operation, the outer peripheral surface of the electrostatic latent image bearing member is electrically charged with a uniform potential by a charger. The uniformly charged surface is exposed to image light to form an electrostatic latent image. The electrostatic latent image is visualized by a developer or toner supplied from a developing device into the toner image. The visualized toner image is transferred onto a recording medium such as paper directly or through an intermediate transfer member in the form of endless belt. Then, the recording medium is transported into a fixing device where the toner image is press-heated and thereby fixed onto the recording medium.

There has been proposed a color image forming apparatus in which a plurality of color toner images are firstly transferred and superimposed sequentially from the electrostatic latent image bearing members onto the belt and then the superimposed toner images are secondly transferred onto the recording medium. The second transfer roller is disposed adjacent the outer peripheral surface of the belt. When a certain transfer voltage is applied between the belt and the second transfer roller, an electric field is generated between the belt and the second transfer roller to electrically bias the toner from the belt toward the transfer roller. This results in that the charged toner images are transferred onto the recording medium passing through the contact region between the belt and the second transfer roller.

Disadvantageously, some foreign matters such as insufficiently charged toner particles fly away into the atmosphere at the first transfer regions. The flying foreign matters may be caught on the outer peripheral surface of the belt and then transferred onto the second transfer roller. The foreign matters on the second transfer roller are then transferred onto the recording medium passing through the second transfer region.

To overcome this problem, JP 2002-82537 A and JP 2005-49449 A, for example, disclose a technique in which a cleaning or scraping blade is disposed in contact with the outer peripheral surface of the belt. According to this technique, the foreign matters are scraped off from the belt by the blade, which prevents the foreign matters from being transferred onto the second transfer roller or the recording medium.

However, this technique has a drawback that, in order to completely remove the foreign matters from the belt by the scraping blade, the blade should be pressed so strongly onto the belt, which in turn deteriorates durabilities of the belt and the blade.

Considering this problem, it can be thought to use a roller made of a metal core and a polyurethane foam layer covering the peripheral surface of the metal core for the cleaning member for removing the foreign matters from the outer peripheral surface of the belt.

The property of the polyurethane foam may determine a cleaning efficiency and/or a cleaning ability. For example, it may be important to adjust the open ratio of cell walls and the number of cells per unit length of the polyurethane foam for increasing the cleaning property of the polyurethane foam layer. The above-mentioned JP 2002-82537 A discloses to use the cleaning blade together with the cleaning roller, however, it is silent about the property of the polyurethane foam including open ratio of cell walls or the number of cells per length.

The present invention is to provide a cleaning roller, for use with the transfer member and an image forming apparatus using the cleaning roller, which is capable of maintaining the initial cleaning ability for a long period of time.

SUMMARY OF THE INVENTION

An object of the present invention is to provide a cleaning roller for removing foreign matters from a toner image bearing member. The cleaning roller has a core and a polyurethane foam layer covering the core to form a peripheral surface of the cleaning roller adapted to be in contact with a peripheral surface of the toner image bearing member. The polyurethane foam is designed so that the number of cell per inch thereof is 30 or more and 60 or less and an open ratio of cell walls thereof is 3% or more and 50% or less.

Another object of the present invention is to provide an image forming apparatus. The apparatus has at least one electrostatic latent image bearing member for bearing an electrostatic latent image formed thereon, the electrostatic latent image being visualized with a toner into a toner image; a transfer member having an endless peripheral surface for receiving the toner image from the electrostatic latent image bearing member and then transferring the toner image onto a recording medium; and a cleaning roller disposed in contact with the peripheral surface of the transfer member to define a contact region therebetween for removing a residual toner which remains on the peripheral surface of the transfer member after a transfer of the toner image from the transfer member to the recording medium. The cleaning roller has a core and a polyurethane foam layer made of polyurethane foam and covering the core to form a peripheral surface of the roller in contact with the peripheral surface of the transfer member. The polyurethane foam is designed so that the number of cell per inch thereof is 30 or more and 60 or less and an open ratio of cell walls thereof is 3% or more and 50% or less.

According to the invention, the cleaning roller collects the foreign matters such as toner particles and external additives from the peripheral surface of the transfer member. In particular, since the polyurethane foam has 30 or more cells per inch, the cleaning roller allows a number of its cells to bring into contact with the residual foreign matters and collect them so effectively. Also, since the polyurethane foam has 60 or less cells per inch, the cells of the polyurethane foam will not be clogged with the collected foreign matters and can remove the residual foreign matters from the transfer member for a long period of time. Further, the polyurethane foam has a closed-cell like, interconnected-cell structure having an open ratio of cell walls of 3% or more and 50% or less. This structure allows the cells to receive more foreign matters than the conventional polyurethane foam with closed-cell structure but accumulate less foreign matters than the conventional polyurethane foam with interconnected-cell structure. This ensures an effective collection of the foreign matters from the transfer member for a long period of time.

BRIEF DESCRIPTION OF THE DRAWINGS

The present invention will become more fully understood from the detailed description and the accompanying drawings, wherein:

FIG. 3 is a cross sectional view showing a part of an intermediate transfer belt and a cleaning roller disposed in contact with the belt;

FIG. 4 is an enlarged cross sectional view of the contact region between the belt and the cleaning roller;

DETAILED DESCRIPTION OF THE PREFERRED EMBODIMENTS

Figure 1:
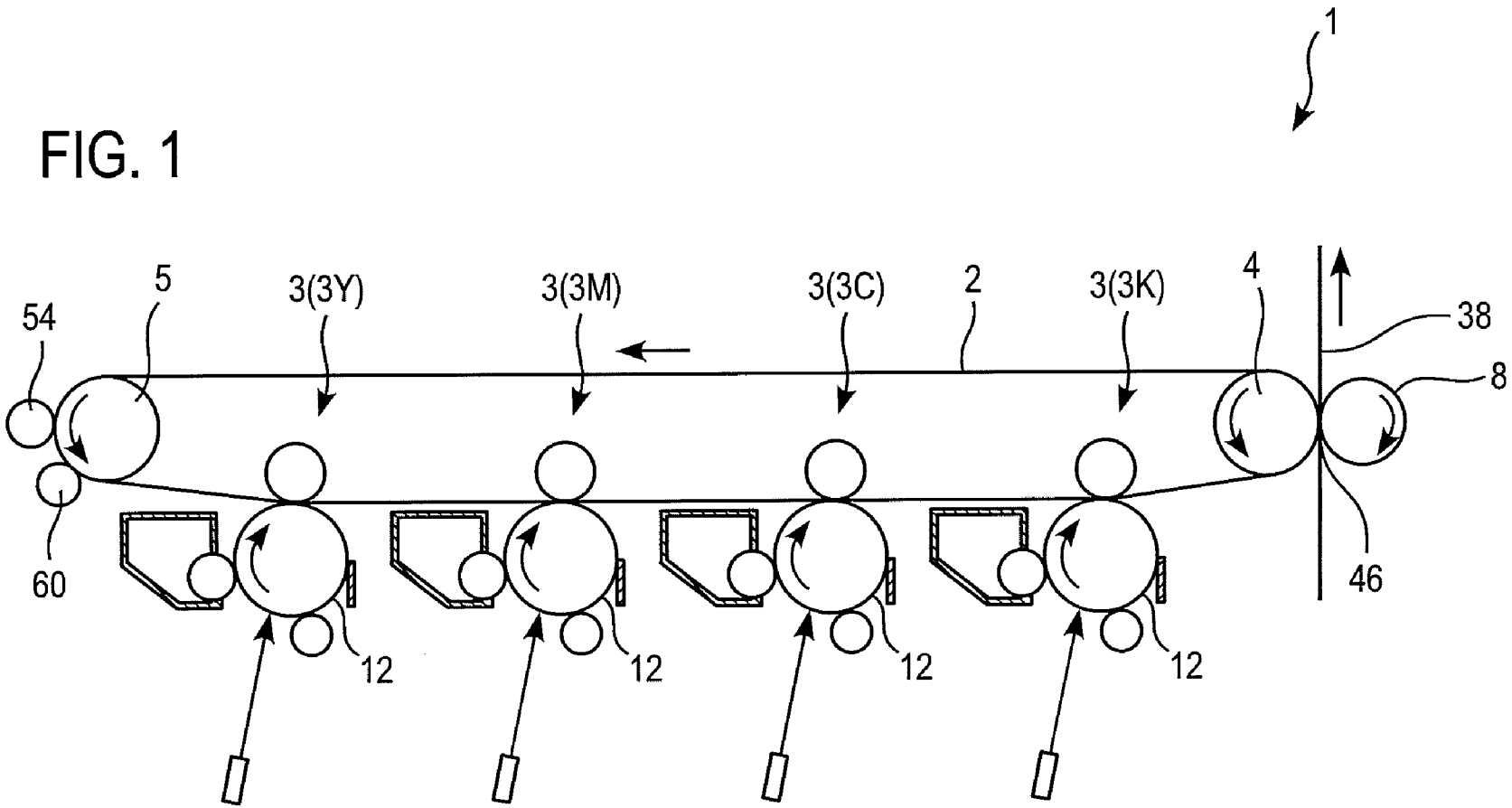
FIG. 1 is a schematic view showing a part of the image forming apparatus according to the invention.

The following description of the preferred embodiments is merely exemplary in nature and are in no way intended to limit the invention, its application, or uses.

Preferred embodiments of the invention will be described with reference to the accompanying drawings. In the following description, spatially relative terms such as "below", "lower", "above", "upper", "left", "right", and the like and directionally relative terms such as "clockwise", and "counterclockwise" may be used herein for ease of description to describe one element or feature relationship to another element(s) or feature(s) as illustrated in the drawings. It will be understood that the spatially and directionally relative terms are intended to encompass different orientations of the device in use or operation in addition to the orientation depicted in the drawings.

Image Forming Apparatus

FIG. 1 shows a part of an electrophotographic image forming apparatus according to the invention. The image forming apparatus may be any one of a copier, a printer, a facsimile, and a multi-peripheral function apparatus including functions of those devices. An embodiment of the invention will be described below in combination with a so-called tandem-type color image forming apparatus, however, the invention can equally be employed in other types of image forming apparatuses, such as so-called four-cycle image forming apparatus.

The image forming apparatus 1 has an endless, image transfer member or intermediate transfer belt 2 entrained around a plurality of rollers 4 and 5. A substrate of the intermediate transfer belt 2 is made of a suitable material, such as polyimide. In the embodiment, the right roller 4 is the drive roller drivingly connected to a motor not shown and the left roller 5 is the driven roller so that, when the motor is driven, the drive roller 4 rotates in the counterclockwise direction to circulate the intermediate roller 2 and thereby rotate the driven roller 5 in the counterclockwise direction.

Four image forming sections 3 for forming powder images of four respective colors, i.e., yellow (Y), magenta (M), cyan (C), and black (K), are disposed adjacent the lower run of the intermediate roller running from the left roller 5 toward the right roller 4.

Figure 2:
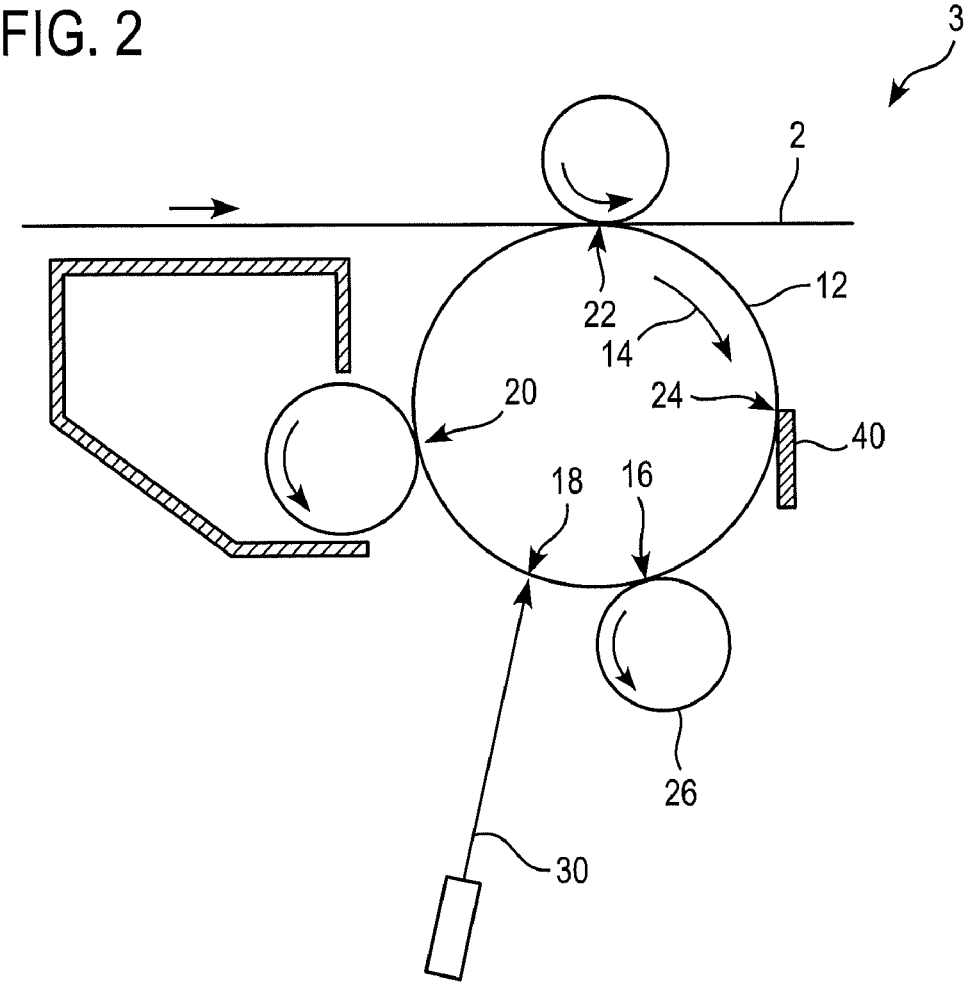
FIG. 2 is a cross sectional view showing an image forming section of the image forming apparatus in FIG. 1.

FIG. 2 shows an enlarged side view of the image forming sections 3 (3Y, 3M, 3C, and 3K) The four sections have substantially the same, except that the color of the developer material or toner used in each section is different from others. The section 3 has an electrostatic latent image bearing member made of, for example, photosensitive drum 12. The photosensitive drum 12 is drivingly connected to a motor not shown so that the drum 12 rotates in the direction indicated by the arrow 14 in response to the driving of the motor. A charge station 16, an exposure station 18, a development station 20, a transfer station 22, and a cleaning station 24 are disposed around the photosensitive drum 12 in the rotational direction of the drum 12.

In the image forming operation, the photosensitive drum 12 rotates in the clockwise direction by the driving of the motor not shown. During the rotation of the drum 12, incremental peripheral portions of the drum passing through the charge station 16 is electrically charged to a certain voltage by the charge roller 26. The electrically charged peripheral portions of the photosensitive drum are exposed to image light 30 at the exposure station 18 to form a corresponding electrostatic latent image. The electrostatic latent image is transported with the rotation of the photosensitive drum 12 into the development station 20 where it is visualized by toner into the toner image. The visualized toner image is then transported with the rotation of the photosensitive drum 12 into the first transfer station 22 where it is transferred onto the belt 2. The image forming operations for four colors are well timed so that the respective color toner images are superimposed on the belt 2. The peripheral portions of the photosensitive drum 12 passed through the transfer station 22 are transported into the cleaning station 24 where the residual toner particles not transferred onto the belt 2 are collected by the cleaning member 40.

Referring back to FIG. 1, a second transfer roller 8 is disposed in contact with the belt portion supported around the drive roller 4 to define a second transfer region 46 between the belt 2 and the second transfer roller 8. A recording sheet 38 such as a paper or a film is transported into the second transfer region 46 where the toner images on the belt 2 are transferred onto the sheet 38. The sheet 38 bearing the transferred toner images is then transported into a fixing station where the toner images are fixed on the sheet 38. The belt portion passed through the transfer region 46 is moved to another contact region between the belt 2 and a cleaning roller 54 which will be described in detail below, where residual toner particles not transferred to the sheet 38 and remaining on the belt 2 are removed from the belt 2.

FIG. 3 shows a portion of the belt supported by the roller 5 and structures provided therearound. The outer peripheral belt portion supported by the roller 5 is in contact with a first cleaning roller 54 and a second cleaning roller 60, provided therearound for cleaning the belt.

Clearing Roller

The first cleaning roller 54 has a metal core 56 and a polyurethane foam layer 58 surrounding the outer peripheral of the metal core 56 and forming a peripheral surface of the roller. The structural details of the polyurethane foam layer 58 will be described later. The cleaning roller 54, which is disposed for rotation and in parallel to the roller 5, is drivingly connected to a motor not shown to rotate in the counterclockwise direction by the driving of the motor. This causes the portions of the belt 2 and the roller 54 in the contact, nipping region 66 to move in the opposite, counter directions, so that as shown in FIG. 4 the foreign matters such as toner particles and external additives are effectively removed from the belt 2 as the belt passes through the nipping region 66.

The peripheral velocity of the cleaning roller 54 is determined in combination with the peripheral velocity of the belt 2. For example, a ratio R of the peripheral velocity VB of the cleaning roller 54 to the peripheral velocity VA of the belt 2, i.e., R=VB/VA, is designed to be 0.1 ore more and 3.0 or less. The peripheral velocity ratio R (=VB/VA) of less than 0.1 can not ensure a sufficient ability of the cleaning roller 54 for scraping off the foreign matters from the belt 2 and the ratio R of more than 3.0 can provide an excessive load to the polyurethane foam layer 58 and the belt 2.

Preferably, a contact force of the cleaning roller 54 against the belt 2 is designed to be 5N or more and 30N or less. The contact force of less than 5N can not ensure a sufficient ability of the cleaning roller 54 for scraping off the foreign matters from the belt 2 and the contact force of more than 30N can provide an excessive load to the belt 2.

Preferably, a contact or nipping width between the cleaning roller 54 and the belt 2 in the rotational direction of the cleaning roller 54 is designed to be 3 mm or more and 8 mm or less. The nipping width of 3 mm or more ensures a sufficient scraping force of the cleaning roller 54 against the foreign matters on the belt 2 and the nipping width of 8 m or less prevents the belt 2 from suffering from an excessive load.

Preferably, a maximum amount of compression of the polyurethane foam layer 58 at the nipping region is determined to be 5% or more and 40% or less of the thickness of the polyurethane foam layer 58. The maximum amount of compression of 5% or more ensures a sufficient scraping force of the cleaning roller 54 against the foreign matters on the belt 2 and the maximum amount of compression of 40% or less prevents the polyurethane foam layer 58 of the cleaning roller 54 from suffering from an excessive load.

Referring back to FIG. 3, a scraping member 70 in the form of blade is disposed in contact with the outer peripheral surface of the cleaning roller 54 so that a part of the foreign matters received within the polyurethane foam layer 58 of the cleaning roller 54 is scraped off at the contact region between the cleaning roller 54 and the scraping member 70. This prevents an excessive amount of foreign matters from being accumulated within the polyurethane foam layer 58. The scraping member 70, however, may be omitted from the image forming apparatus.

The cleaning roller 54 may be connected to a power source to apply a certain voltage thereto. In this instance, when the power is turned on to apply the voltage to the cleaning roller 54, an electric field is generated between the belt 2 and the cleaning roller 54 to electrostatically forces the toner particles from the belt 2 to the cleaning roller 54, which increases the cleaning ability of the foreign matters from the belt 2 to the cleaning roller 54.

Similar to the first cleaning roller 54, the second cleaning roller 60 has a metal core 62 and a polyurethane foam layer 64 surrounding the periphery of the roller 60. The second cleaning roller 60 is disposed in parallel to the roller 5 and mounted for rotation so that the peripheral portions of the cleaning roller 60 and the belt 2 move in the opposite, counter directions at the contact region between the roller 60 and the belt 2. In this embodiment, although the second cleaning roller 60 is disposed on the downstream side of the first cleaning roller 54 with respect to the rotational direction of the belt 2, it may be disposed on the upstream side thereof. Although not shown, a scraping member may also be provided in contact with the polyurethane foam layer 64 to scrape off the foreign matters from the polyurethane foam layer 64. Alternatively, another type of scraping or cleaning member may be used instead. Although two cleaning members are provided in this embodiment, it is not necessary to provide two cleaning members and providing only the first cleaning roller 54 is sufficient.

Figure 5:
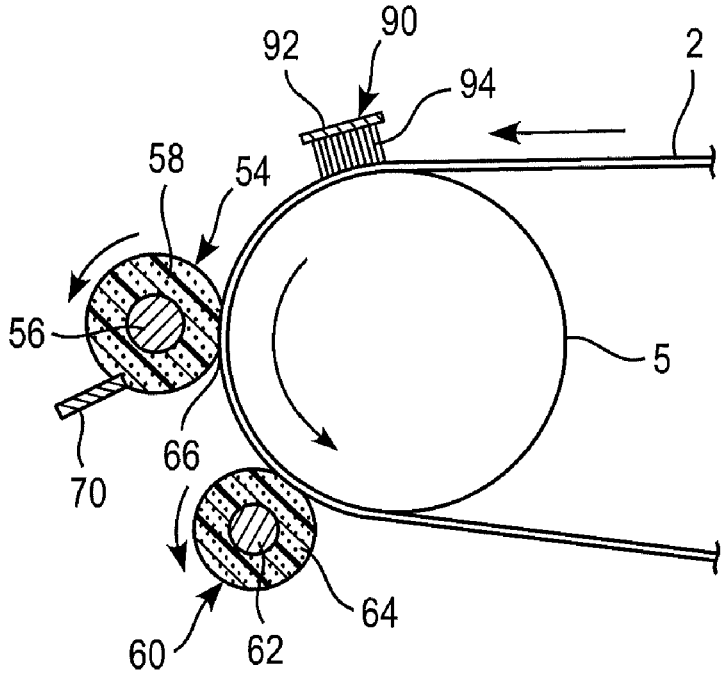
FIG. 5 is a cross sectional view showing another embodiment in which a charging brush is added to the previous embodiment shown in FIG. 3.
Figure 6:
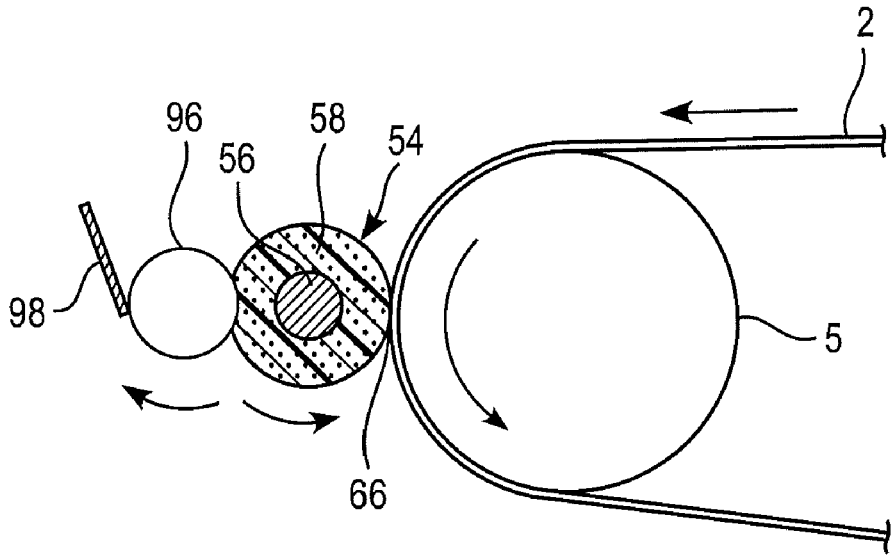
FIG. 6 is a cross sectional view showing another embodiment in which a metal roller is disposed in contact with the cleaning roller.
Figure 7:
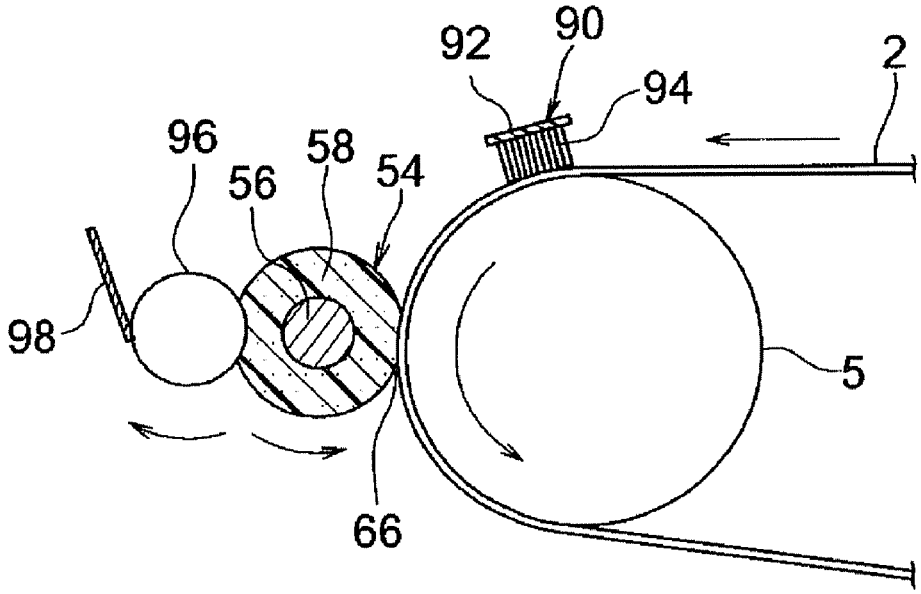
FIG. 7 is a cross sectional view showing another embodiment in which a charging brush is added to the previous embodiment shown in FIG. 6.

The arrangements may be modified in various ways as shown in FIGS. 5-7, as necessary. In those modifications, the cleaning roller 54 is commonly used, similar to the embodiment in FIG. 3.

In the modification in FIG. 5, a charging brush 90 is added. The charging brush 90 has a substrate member 92 and a number of fibers 94 planted in the substrate member 92 and is disposed so that distal ends of the fibers make contacts with the outer peripheral surface of the belt 2.

Preferably, a certain voltage is applied from a power source not shown to the charging brush 90. This causes that the residual toner particles transported in the contact region between the belt 2 and the charging brush 90 are electrically charged into a certain polarity, i.e., negative or positive polarity, by the electric field formed therebetween. Then, the electrically charged toner particles are transported by the rotation of the belt 2 into the contact region between the cleaning roller 54 and the belt 2 where they are collected by the cleaning roller 54 with an aid of the electric field between the cleaning roller 54 and the belt 2.

Preferably, the substrate member 92 is made of resin material of, for example, nylon, polyester, acrylic, or vinylon, which allows the fibers 94 to be planted in the substrate member and also to provide an electric conductivity for the fibers 94.

The brush fiber 94 is made of resin, for example, nylon (nylon 6 or 6-6), polyester, fluorine, acrylic, or vinylon, or any combination thereof. An electric conductivity is provided to the brush fibers 94 by the addition of conductive agent such as carbon black. The brush fibers 94 have a diameter or thickness of 10 μm or more and 50 μm or less, preferably 20 μm or more and 30 μm or less. A density of the fibers 94 is, for example, 50 kF/sq.in. or more and 400 kF/sq.in. or less, preferably 200 kF/sq.in. or more and 300 kF/sq.in. or less. A length of the fibers 94 from the substrate is, for example, 0.5 mm or more and 3 mm or less, preferably 1 mm or more and 2 mm or less. An electric resistance of the original fiber is $10^5\Omega$ or more and $10^{14}\Omega$ or less, preferably $10^6\Omega$ or more and $10^8\Omega$ or less.

Alternatively, other charging members such as charging blade may be used. Typically, the charging blade is disposed in contact with the outer periphery of the belt 2. The charging blade is made of the same material as the brush fibers 94 or of metal such as stainless, aluminum or alloys thereof. Other charging members such as brush roller or foam roller may be used instead.

The charging member or the charging brush 90 is used for charging the toner particles being transported in the contact region between the charging member and the belt 2 with a certain polarity.

For example, when using toner particles to be charged negatively, the untransferred toner particles remaining on the portion of the belt 2 passed through the second transfer region 46 may include not only negatively charged toner particles but also some positively charged toner particles. Also, some toner particles are not charged, i.e., electrically neutral, and some are weakly charged. Therefore, in order for the charging member to provide a uniform negative charge to the untransferred toner particles on the belt 2, an electric current of, for example, −100 μA or more and −10 μA or less, preferably −80

μA or more and −40 μA or less, is applied to the charging member. This allows that the negatively charged toner particles on the belt 2 to be collected easily by the positively charged cleaning roller 54. In order for the charging member to provide a uniform positive charge to the untransferred toner particles on the belt 2, an electric current of, for example, 10 μA or more and 10 μA or less, preferably 40 μA or more and 80 μA or less, is applied to the charging member. This allows that the positively charged toner particles on the belt 2 to be collected easily by the negatively charged cleaning roller 54.

The polarity of the voltage to be applied to the charging member may be changed as necessary. For example, when using a charging member in the form of brush and a negative voltage is applied to the charge member, the positively charged toner particles and the weakly charged toner particles tend to be accumulated in the charging member. Then, by applying opposite, positive voltage to the charging member during the waiting time between the image forming operations, the tone particles accumulated in the charging member may be electrically discharged therefrom onto the belt 2. After the completion of the discharge of the toner particles, the polarity of the voltage is changed to negative. This causes the toner particles on the belt to be negatively charged by the charging member, so that the negatively charged toner particles are then well collected by the cleaning roller 54.

FIG. 6 shows another embodiment which includes a metal roller 96 for collecting toner particles from the cleaning roller 54 and a scraper 98 for scraping off toner particles from the metal roller 96. The metal roller 96 may be made of aluminum or iron, for example. The outer peripheral surface of the metal roller 96 may be treated, as necessary. In this embodiment, the metal roller 96 is provided in contact with the left portion of the cleaning roller 54, away from the contact region between the cleaning roller 54 and the belt 2. The metal roller 96 is disposed in parallel to the cleaning roller 54. As shown in FIG. 6, the metal roller 96 is mounted for rotation in the clockwise direction so that the portions of the metal roller 54 and the metal roller 96 in the contact region move in the same direction. Alternatively, it may be designed so that the portions of the metal roller 54 and the metal roller 96 in the contact region move in the different directions. The scraper 98 is disposed so that its distal end makes a contact with the outer periphery of the metal roller 96. The scraper 98 may be made of, for example, metal such as stainless or rubber of polyurethane rubber.

In this embodiment, the metal roller 96 may be connected to a power source not shown for biasing the cleaning roller 54. In this instance, a direct current of about −30 μA may be applied to the roller 5 through the metal roller 96 and the cleaning roller 54. This causes an electric field which electrostatically forces the toner particles from the belt 2 to the cleaning roller 54. Alternatively, the power source may be connected to the scraper 98, instead of the metal roller 96.

FIG. 7 shows another embodiment in which the charging brush 90 is provided to the previous embodiment shown in FIG. 6. This allows that the toner particles on the belt 2 are uniformly charged by the charging brush 90, so that the uniformly charged toner particles are collected so effectively by the cleaning roller 54. Although the charging brush 90 has the same structure as that indicated in FIG. 5, another type charging member may be instead.

Polyurethane Foam of Cleaning Roller

Figure 8:
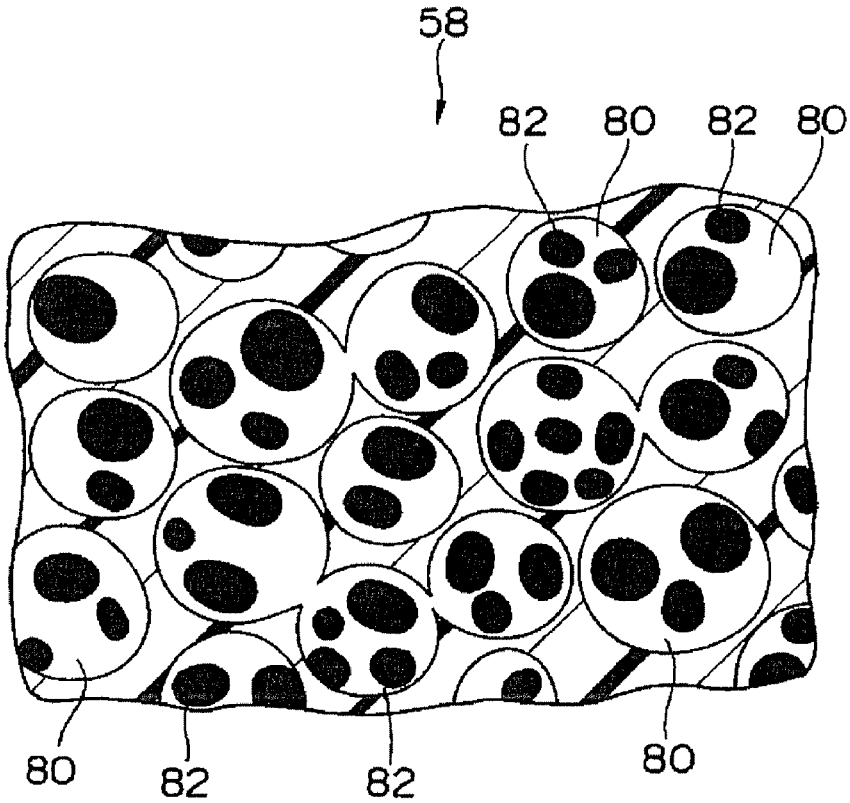
FIG. 8 is an enlarged cross sectional view showing cell structures formed in the polyurethane foam.

As shown in FIG. 8, the polyurethane foam layer 58 includes a number of foams or cells 80. The cells 80 are connected to the adjacent cell or cells 80 through the opening or openings 82 formed in the cell walls. In the following description, an open ratio of the polyurethane foam layer 58 is used. The open ratio is a ratio of the area S1 of the opening or openings 82 to the whole internal area S of the cell 80 including the opening or openings, i.e., 100(S1/S). Preferably, the open ratio of the polyurethane foam layer 58 is 3% or more and 50% or less. This open ratio of the polyurethane foam layer 58 is greater than that (about 1%) of a typical polyurethane foam with closed-cell structure manufactured by, for example, a conventional mechanical frothing process and less than that (60%) of the polyurethane foam with interconnected-cell structure manufactured by a conventional chemical foaming process. This means that the polyurethane foam layer 58 has the interconnected-cell structure but has the open ratio close to that of the closed-cell polyurethane foam and away from that of the interconnected-cell polyurethane foam. This allows that the polyurethane foam layer 58 accumulates more foreign matters than the conventional closed-cell polyurethane foam layer. This also prevents the foreign matters from staying and adhering in the cells on the peripheral portion of the polyurethane foam layer 58. This in turn prevents the reduction of the scraping ability of the polyurethane foam layer 58 and possible damages on the belt 2 which would otherwise be cause by the contact with the adhered toner. Also, the cells of the polyurethane foam layer 58 is unlikely to be clogged by the toner particles, compared with the conventional interconnected-cell polyurethane foam, so that the cleaning ability of the cleaning roller 54 is well maintained for a long period of time.

The number of cells per square inch of the polyurethane foam layer 58 is 30 or more and 60 or less. This number is smaller than that of the closed-cell polyurethane foam (about 100) but greater than that of the interconnected-cell polyurethane foam (about 25). This results in that the polyurethane foam layer 58 allows larger number of cells to make contacts with the foreign matters on the belt 2 in the contact region 66 between the cleaning roller 54 and the belt 2, than the conventional interconnected-cell polyurethane foam, which ensures the foreign matters on the belt to be well scraped off. Also, each cell of the polyurethane foam layer 58 is greater than that of the closed-cell polyurethane foam, which prevents the cells from being clogged with the toner particles and/or external additives. This also ensures that the foreign matters on the belt 2 are well scraped by the contact with the polyurethane foam layer 58.

The polyurethane foam layer 58 has a relatively lower hardness substantially the same as that of the conventional interconnected-cell polyurethane foam. In this application, the hardness of the polyurethane foam layer is defined by a load per unit length that is measured on a surface thereof when the polyurethane foam layer is compressed to 70% of the original thickness (i.e., by 30% in thickness) by forcing the surface on a fixed member.

The method for measuring the hardness will be described in detail. In this measurement, prepared is a fixed aluminum circular plate having a diameter of 55 mm. The cleaning roller 54 is supported by an elevator. The elevator holds the opposite ends of the roller and forces the roller down onto the surface of the metal circular plate to compress the roller. The polyurethane foam layer of the roller is compressed to 70% of its original thickness and the load on the circular plate, i.e., hardness, is measured.

Preferably, the hardness so measured is 1 gf/mm or more and 5 gf/mm or less, which is less than the conventional closed-cell polyurethane foam (about 8.5 gf/cm) and larger than the conventional interconnected-cell foam (about 0.8 gf/mm) measured in the same manner. In particular, the hardness of 2 gf/mm or more ensures the polyurethane foam layer 58 to collect the foreign matters, which prevents the foreign matters from passing through the nipping region 66 between the polyurethane foam layer 58 and the belt 2. The hardness of 6 gf/mm or less prevents the polyurethane foam layer 58 from applying an excessive load on the outer periphery of the belt 2, which further prevents the foreign matters from being pressed and rubbed onto the belt 2 to form an unwanted film (filming) thereon.

Preferably, the average cell diameter of the cells in the polyurethane foam layer 58 is 150 μm or more and 500 μm or less, which is smaller than that of the conventional interconnected-cell polyurethane foam (about 700 μm) and larger than that of the conventional closed-cell polyurethane foam (80 μm). As above, since the polyurethane foam layer 58 has smaller cells than the conventional interconnected-cell polyurethane foam, the foam layer 58 makes frequent contacts with the foreign matters to scrape them so effectively from the belt 2. This causes the small size toner particles having diameters ranging from 4.5 to 7.0 μm and also external additives to be well scraped off.

The average diameter of the toner particles was measured using a particle shape and size analyzer FPIA-2100 commercially available from Sysmex Corporation. According to this analyzer, the average diameter measured by this equipment is a volumetric average diameter. The volumetric average diameter is measured by calculating projected area of each particle, assuming spherical balls each having the same calculated areas, determining diameters and volumes for a certain number of balls, drawing a distribution curve of the integrated value of volumes in the graph with X-axis (horizontal axis) of diameter and Y-axis (vertical axis) of volume, identifying the diameter corresponding to the integrated volume of 50% as the volumetric average diameter of the particles.

Preferably, the density of the polyurethane foam layer 58 0.03 g/cm$^3$ or more and 0.2 g/cm$^3$ or less. The density of 0.2 g/cm$^3$ or less ensures a sufficient elasticity to prevent the belt 2 from being pressed excessively by the polyurethane foam layer 58. The density of 0.03 g/cm$^3$ or more provides a necessary rigidity to the polyurethane foam layer 58.

To generate the electric field between the belt 2 and the cleaning roller 54, electric conductivity is provided to the polyurethane foam layer 58. In this embodiment, the volume resistance of the polyurethane foam layer 58 is $10^2$ Ωcm or more and $10^6$ Ωcm or less, which provides an appropriate conductivity to the polyurethane foam layer 58 and thereby to form an appropriate electric filed between the belt 2 and the cleaning roller 54.

Manufacturing Process of Polyurethane Foam

A process for manufacturing the polyurethane foam of the layer 58 will be described. According to the invention, the polyurethane foam is manufactured through a process which is a combination of the conventional mechanical and chemical frothing methods.

According the conventional mechanical and chemical frothing methods, polyol and isocyanate are commonly used at foaming. The mechanical frothing employs a physical foaming technique in which bubbles of inert gas, for example, is mixed in, without using any foaming agent. According to the chemical frothing, on the other hand, employs a chemical foaming technique in which foams are generated through the chemical reaction between isocyanate and foaming agent mixed therewith. The mechanical frothing is able to produce homogeneous closed-cell structure but is unable to produce low-density interconnected-cell structure, while the chemical frothing is able to produce low-density interconnected-cell structure but is unable to produce homogeneous closed-cell structure.

According to the method of the present invention for producing polyurethane foam, not only polyol, isocyanate, and foaming gas but also foaming agent is used so that the physical foaming using bubbles and the chemical foaming using the chemical reaction of isocyanate and the foaming agent are combined. This results in that the homogeneous cells are formed through the physical foaming, which are connected with each other through the chemical foaming to form homogeneous and low density polyurethane foam with closed-cell like, interconnected-cell structure.

The manufacturing method of the polyurethane foam will be described in detail below. The method has preparing, mixing, and heating processes.

In the preparing process, the various raw materials necessary for manufacturing the polyurethane foam are prepared. The materials include polyol, isocyanate, inner gas for bubbling, and foaming agent, and catalyst.

A single or a plurality of known polyols with active hydrogen group are selected from, for example, polyetherpolyol, polyesterpolyol, polycarbonatepolyol, and polydiene-based polyol. Isocyanate is selected from, for example, armatic, aliphatic, and alicyclic polyisocyanate including toluenediphenyldiisocyanate (TDI), TDI prepolymer, methylenediphenyldiisocyanate (MDI), crude MDI, polymeric MDI, uletodiam metamorphic MDI, or carbodiimide metamorphic MDI. Inert gas such as nitrogen gas is used for the bubbling gas. The foaming agent is selected from materials, such as water, capable of reacting chemically with isocyanate to generate gas. The foaming agent is mixed with polyol before the mixing process. The catalyst is amine catalyst or organic acid series catalyst. The amine catalyst is used mainly for accelerating the chemical foaming. The organic acid series catalyst is used mainly for hardening the frames of the polyurethane foam. Preferably, heat-activated thermosensitive catalyst is used for the organic acid series catalyst. This retards the hardening of the frames of polyurethane foam than the chemical foaming by amine catalyst to ensure the chemical foaming.

A hardness of the polyurethane foam depends upon the type of polyol and isocyanate index. In this application, the isocyanate index is given in percentage of the number of moles N of isocyanate group of isocyanate to the total number of moles M of hydroxy of the foaming agent and hydroxy of polyol. In order to attain the above-described desired hardness for the polyurethane foam, polyol is preferably selected from polyetherpolyol or polyesterpolyol with molecular weight of 1,000-6,000 and 2-5 functional groups and is adjusted to have an isocyanate index of 90-110.

The foaming agent, or water, reacts chemically with isocyanate to generate carbon dioxide for foaming. In order to manufacture polyurethane foam with smaller cells and lower density, it is necessary for the carbon dioxide produced by the chemical reaction between water and isocyanate to be introduced into the physically generated bubbles. For this purpose, a mixed quantity of the water is adjusted to be 0.3-1.5 parts per 100 parts by mass of polyol.

In the mixing process, polyol mixed with foaming agent of water, for example, isocyanate, foaming gas, and catalyst are mixed. The mixing produces physical bubbles of foaming gas, which eventually form homogeneous cells. Then, the foaming agent included in polyol chemically reacts with isocyanate to produce gas of carbon dioxide which enters into the physically generated bubbles to enlarge the bubbles. A part of the enlarged bubbles are thereafter interconnected. According to the process, homogeneous cells with enlarged diameters are generated in the polyurethane foam.

In the heating process, the mixture is heated for a certain period of time, which accelerates resinification to harden the frames of the polyurethane foam. The heating temperature and time are determined according to the conventional mechanical frothing and the materials of the polyurethane foam.

According the above-described manufacturing process, polyurethane foam with an elevated open ratio of cell walls, compared with that manufactured by the mechanical frothing. This allows liquid to enter into the cells of the polyurethane foam easily. With this feature, electric conductivity is readily provided to the polyurethane foam manufactured by the method of the invention simply by dipping the polyurethane foam into liquid containing electrically conductive material.

The polyurethane foam so manufactured is fixed on the metal core and machined into a desired shape to produce the cleaning roller 54. Additionally, before fixing the polyurethane foam on the metal core, the polyurethane foam may be dipped in the liquid containing electrically conductive material or materials to provide it conductivity and then dried.

The above-described manufacturing process is simply a preferred embodiment of the invention and the present invention is not limited thereto. For example, the polyurethane foam may be manufactured in different manner.

Embodiments

Tests were conducted to identify suitable physical properties for the polyurethane foam layer of the cleaning roller. The properties include the number of cells, the open ratio of cell walls, the hardness, the average cell diameter, the density, and the volume resistance.

An image forming apparatus commercially available from Konicaminolta Business Technologies, Inc. under the trade name bizhub C350 was used for the tests. Although the apparatus originally incorporates a cleaning brush, it was replaced by the cleaning roller 54 as indicated in FIG. 6.

As shown in Table 1, 16 samples of polyurethane foams were manufactured. The samples were made of several materials, i.e., polyol, isocyanate, amine catalyst, organic acid series catalyst, water (foaming agent), and foaming control agent, which were processed according to the above-described manufacturing method.

The polyol was Polyetherpolyol commercially available from Mitsuitakeda chemical under the trade name of Actocoal with average molecular mass of 3,000. The isocyanate was methylenediphenyldiisocyanate (MDI) commercially available from Nippon polyurethane industry co., Ltd. under the trade name of Millionate MTL-S. The amine catalyst was commercially available from Kao Corporation under the trade name of Kaolyzer No. 23NP. The organic acid series catalyst was commercially available from Pantechnology Ltd. under the trade name EP73660A. The foaming control agent was normal chain dimethylpolysiloxane commercially available from Momentive Performance Materials Inc. under the trade name Niax Silicone L5614. The amount of materials are indicated in Table 1.

TABLE 1

| | | Types of polyurethane foam | | | | | | | |
|---|---|---|---|---|---|---|---|---|---|
| | | 1 | 2 | 3 | 4 | 5 | 6 | 7 | 8 |
| Materials (parts by weight) | polyol | 110 | 110 | 110 | 110 | 110 | 110 | 110 | 110 |
| | isocyanate | 31.9 | 32.2 | 36.5 | 33.3 | 40.5 | 37.3 | 31.0 | 27.8 |
| | amine catalyst | 0.33 | 0.33 | 0.42 | 0.36 | 0.49 | 0.44 | 0.32 | 0.26 |
| | organic acid group catalyst | 4.2 | 4.2 | 4.2 | 4.2 | 4.2 | 4.2 | 4.2 | 4.2 |
| | water | 1.1 | 1.1 | 1.3 | 1.1 | 1.6 | 1.4 | 1.0 | 0.8 |
| | foam control agent | 9.3 | 9.3 | 9.3 | 9.2 | 9.3 | 9.2 | 9.3 | 9.2 |
| Properties | number of cells per inch | 50 | 55 | 30 | 30 | 30 | 30 | 60 | 60 |
| | average cell number (μm) | 300 | 250 | 500 | 500 | 500 | 500 | 350 | 350 |
| | hardness of roller (gf/mm) | 3 | 3 | 1 | 5 | 1 | 5 | 1 | 5 |
| | open ratio of cell wall (%) | 15 | 20 | 3 | 3 | 40 | 40 | 3 | 3 |
| | density (g/cm3) | 0.07 | 0.05 | 0.02 | 0.02 | 0.02 | 0.02 | 0.07 | 0.07 |

| | | Types of polyurethane foam | | | | | | | |
|---|---|---|---|---|---|---|---|---|---|
| | | 9 | 10 | 11 | 12 | 13 | 14 | 15 | 16 |
| Materials (parts by weight) | polyol | 110 | 110 | 110 | 110 | 110 | 110 | 110 | 110 |
| | isocyanate | 35.0 | 31.8 | 31.2 | 25.8 | 38.3 | 29.8 | 29.9 | 34.1 |
| | amine catalyst | 0.39 | 0.33 | 0.32 | 0.22 | 0.45 | 0.29 | 0.29 | 0.38 |
| | organic acid group catalyst | 4.2 | 4.2 | 4.2 | 4.2 | 4.2 | 4.2 | 4.2 | 4.2 |
| | water | 1.3 | 1.1 | 1.0 | 0.7 | 1.4 | 0.9 | 0.9 | 1.2 |
| | foam control agent | 9.3 | 9.2 | 9.2 | 9.2 | 9.2 | 9.2 | 9.3 | 9.3 |
| Properties | number of cells per inch | 60 | 60 | 60 | 30 | 25 | 65 | 50 | 50 |
| | average cell number (μm) | 350 | 350 | 150 | 150 | 550 | 300 | 300 | 300 |
| | hardness of roller (gf/mm) | 1 | 5 | 5 | 5 | 3 | 3 | 3 | 3 |
| | open ratio of cell wall (%) | 40 | 40 | 50 | 3 | 15 | 15 | 2 | 55 |
| | density (g/cm3) | 0.07 | 0.07 | 0.03 | 0.2 | 0.01 | 0.1 | 0.07 | 0.07 |

Methods for measuring physical properties of the samples 1-16 will be described. The number of cells was determined by scanning 24 surface portions of the cleaning roller, i.e, three portions in the longitudinal direction by eight portions in the peripheral direction, by using scanning electron microscope (SEM), counting the number of cells per inch for each portion, and obtaining the average number of cells per inch. The open ratio of cell walls was determined by viewing a surface portion of the polyurethane foam layer at 100-fold magnification by using SEM, calculating the total area S1 of the openings of the cell walls and the whole area S in the field of view, and calculating the open ratio as 100(S1/S). The hardness was determined by forcing aluminum plate with a diameter of 550 mm against the polyurethane foam layer to compress the foam layer 70% of its original thickness, and measuring the applied force per length (gf/mm) in the longitudinal direction of the roller. The average cell diameter was determined by scanning 24 surface portions of the cleaning roller, i.e, three portions in the longitudinal direction by eight portions in the peripheral direction, by using scanning electron microscope (SEM), measuring diameters of 10 cells in each field of view (i.e., 240 cells in total), and averaging the measured diameters. The density was determined by subtracting the weight of metal core from the weight of the cleaning roller to obtain the weight of the polyurethane foam, calculating the volume of the polyurethane foam using its sizes, and calculating the density by dividing the weight of the polyurethane foam layer by its volume.

Two types of toners, toner A with an average diameter of 4.5 μm and toner B with an average diameter of 7.0 μm, were used for respective samples 1-16 (i.e., test numbers A1-A16 shown in Table 2 and B1-B16 shown in Table 3). A voltage was applied to the metal roller 96 so as to flow direct current of −30 μA from the metal roller 96 via the cleaning roller 54 to the belt 2. In each test, the cleaning roller was rotated so that the roller and the belt move in the different directions in the contact region thereof. A ratio of the peripheral velocity of the cleaning roller VB to that of the belt VA, i.e., VB/VA, was set 0.5. The materials and properties of the polyurethane foams used are indicated in Tables 2 and 3. Electric conductivities were provided to the polyurethane foams, as indicated in Tables 2 and 3. Others such as contact force of the cleaning roller against the belt, nipping width in the rotational direction between the cleaning roller and the belt, and maximum amount of compression of the polyurethane foam layer are also indicated in Tables 2 and 3.

Evaluations were made for respective tests, in each of which a solid image was printed on 50,000 papers by the image forming apparatus under the temperature of 28° C. and relative humidity of 85%. The evaluation was made in terms of initial image quality, toner stain caused by the adhesion of toner particles on the back surface of the paper, and damages on the belt after printings.

In the evaluation, the number of printed paper on which the toner stain was first observed was recorded. The belt damages were classified into two, minor damage A and major damage B.

The result of the evaluation is also indicated in Tables 2 and 3.

As can be seen from the tables, no damage on the initial image, no toner stain, or no damage on the belt was observed in the tests A1-A12, and B1-B12, except for the tests A13-A16 and B13-B13.

Sample 13 was used for tests A13 and B13. The toner stain was observed on the 5,000th printed paper in test A13 and on the 10,000th printed paper in test B13. It is considered that, since the number of cells per inch in sample 13 (25 cells per inch) was smaller than that of others (30-65 cells per inch), the cell walls made less frequency of contacts with the foreign mattes on the belt and therefore the polyurethane foam layer was unable to scrape off the foreign matters so effectively. It is also considered that, due to this degraded cleaning ability, the foreign matters on the belt were not scraped off effectively by the cleaning roller and then they were forced and rubbed on the belt by the roller to slightly damage the surface of the belt. It is further considered that the deterioration of the initial image quality was caused by the fact that the remaining toner particles, not scraped off by the cleaning roller, were transferred onto the papers. From the test results of the sample 13, it is considered that the number of cells per inch on the polyurethane foam layer be preferably set 30 or more.

Sample 14 was used for tests A14 and B14. The toner stain was observed in 3,000th printed paper in test A14 and in 5,000th printed paper in test B14. It is considered that, since the number of cells per inch in sample 14 (65 cells per inch) was larger than that of others (25-60 cells per inch), the small cells were clogged with foreign matters such as toner particles to reduce scraping ability thereof and, in turn, to increase the foreign matters on the belt, which damaged the peripheral surface of the belt with an aid of the contact force of the cleaning roller. Therefore, it is considered that the number of cells per inch on the polyurethane foam layer be preferably set 60 or less, more preferably 30 or more and 60 or less when considered the test results of samples 13 and 14 in combination.

Sample 15 was used for tests A15 and B15. The toner stain was observed in 10,000th printed paper in test A15 and in 12,000th printed paper in test B15. It is considered that the reason is that the sample 15 had a closed-cell like structure of which open ratio of cell walls (2%) was less than that of others (3-55%). Therefore, it is considered that the foreign matters removed by the cleaning roller were unable to invade deeply into the interior of polyurethane foam but remained in the peripheral cells, which reduced the contact frequency of the cell wall against the belt to deteriorate the scraping ability of the cleaning roller. It is also considered that the clogged foreign matters grown up into a solid body which damaged the outer periphery of the belt. Therefore, it is considered that the open ratio of cell walls of the polyurethane foam layer be 3% or more.

Sample 16 was used for tests A16 and B16. The toner stain was observed in 5,000th printed paper in test A16 and in 7,000th printed paper in test B16. It is considered that the reason is that the sample 16 had a large open ratio of cell walls (55%) which was larger than that of others (2-50%). Therefore, it is considered that the foreign matters removed by the cleaning roller were accumulated in the interior of the foam layer with the increase of the printing number, which eventually reduced the scraping ability of the cleaning roller and thereby allowed the generation of the adhesion of the foreign matters on the belt which was pressed against the belt by the cleaning roller to damage the peripheral surface of the belt. Therefore, it is considered that the open ratio of cell walls of the polyurethane foam layer be 50% or less, more preferably 3% or more and 50% or less when considered the test results of samples 15 and 16 in combination.

In tests A1-A12 and B1-B12 with good evaluations, the hardness of the polyurethane foam layer was 1-5 gh/mm. This means that the hardness of the polyurethane foam layer in this range ensures a good cleaning ability of the roller provided that other factors reside within the above-described preferred ranges.

Also, in tests A1-A12 and B1-B12, the average cell diameter of the polyurethane foam was 150-500 μm. This means that the average cell diameter in this range ensures a good cleaning ability of the roller provided that other factors reside within the above-described preferred ranges.

Further, in tests A1-A12 and B1-B12, the density of the polyurethane foam was 0.03-0.2 g/cm$^3$. This means that the density of the polyurethane foam in this range ensures a good cleaning ability of the roller provided that other factors reside within the above-described preferred ranges.

Furthermore, in tests A1-A12 and B1-B12, the volume resistance of the polyurethane foam was $10^2$-$10^6$ Ωcm. This means that the volume resistance of the polyurethane foam in this range ensures a good cleaning ability of the roller provided that other factors reside within the above-described preferred ranges.

Moreover, good evaluations were provided to the tests A1-A12 in which toner A with the average diameter of 4.5 μm were used and the tests B1-B12 in which toner B with the average diameter of 7.0 μm were used. This means that the usage of the toner particles of which average diameter in this range ensures a good cleaning ability of the roller provided that other factors reside within the above-described preferred ranges.

TABLE 2

| | Polyurethane foam layer of intermediate transfer belt | | | | | | | | | | | | |
|---|---|---|---|---|---|---|---|---|---|---|---|---|---|
| Test No. | type | number of cell per inch | open ratio of cell walls (%) | hardness of roller (gf/mm) | average cell number (μm) | density (g/cm3) | volume resistance (Ωcm) | contct pressure (N/m) | nip width (mm) | amount of compres-soin (%) | initial image | toner stain | damage on belt |
| A1 | 1 | 50 | 15 | 3 | 300 | 0.07 | $10^3$ | 15 | 5.0 | 29 | | None | None |
| A2 | 2 | 55 | 20 | 3 | 250 | 0.05 | $10^3$ | 15 | 5.0 | 29 | Good | None | None |
| A3 | 3 | 30 | 3 | 1 | 500 | 0.02 | $10^3$ | 15 | 5.0 | 29 | Good | None | None |
| A4 | 4 | 30 | 3 | 5 | 500 | 0.02 | $10^3$ | 15 | 5.0 | 29 | Good | None | None |
| A5 | 5 | 30 | 40 | 1 | 500 | 0.02 | $10^3$ | 15 | 5.0 | 29 | Good | None | None |
| A6 | 6 | 30 | 40 | 5 | 500 | 0.02 | $10^3$ | 15 | 5.0 | 29 | Good | None | None |
| A7 | 7 | 60 | 3 | 1 | 350 | 0.07 | $10^3$ | 15 | 5.0 | 29 | Good | None | None |
| A8 | 8 | 60 | 3 | 5 | 350 | 0.07 | $10^3$ | 15 | 5.0 | 29 | Good | None | None |
| A9 | 9 | 60 | 40 | 1 | 350 | 0.07 | $10^3$ | 15 | 5.0 | 29 | Good | None | None |
| A10 | 10 | 60 | 40 | 5 | 350 | 0.07 | $10^3$ | 15 | 5.0 | 29 | Good | None | None |
| A11 | 11 | 60 | 50 | 5 | 150 | 0.03 | $10^2$ | 5 | 3.0 | 5 | Good | None | None |
| A12 | 12 | 30 | 3 | 5 | 150 | 0.20 | $10^8$ | 30 | 8.0 | 40 | Good | None | None |
| A13 | 13 | 25 | 15 | 3 | 550 | 0.01 | $10^3$ | 15 | 5.0 | 29 | Not Good | 5000 | A |
| A14 | 14 | 65 | 15 | 3 | 300 | 0.10 | $10^3$ | 15 | 5.0 | 29 | Good | 3000 | B |
| A15 | 15 | 50 | 2 | 3 | 300 | 0.07 | $10^3$ | 15 | 5.0 | 29 | Good | 10000 | A |
| A16 | 16 | 50 | 55 | 3 | 300 | 0.07 | $10^3$ | 15 | 5.0 | 29 | Good | 5000 | B |

TABLE 3

| | Polyurethane foam layer of intermediate transfer belt | | | | | | | | | | | | |
|---|---|---|---|---|---|---|---|---|---|---|---|---|---|
| | type | number of cell per inch | open ratio of cell walls (%) | hardness of roller (gf/mm) | average cell number (μm) | density (g/cm3) | volume resistance (Ωcm) | contct pressure (N/m) | nip width (mm) | amount of compressoin (%) | initial image | toner stain | damage on belt |
| B1 | 1 | 50 | 15 | 3 | 300 | 0.07 | $10^3$ | 15 | 5.0 | 29 | Good | None | None |
| B2 | 2 | 55 | 20 | 3 | 250 | 0.05 | $10^3$ | 15 | 5.0 | 29 | Good | None | None |
| B3 | 3 | 30 | 3 | 1 | 500 | 0.02 | $10^3$ | 15 | 5.0 | 29 | Good | None | None |
| B4 | 4 | 30 | 3 | 5 | 500 | 0.02 | $10^3$ | 15 | 5.0 | 29 | Good | None | None |
| B5 | 5 | 30 | 40 | 1 | 500 | 0.02 | $10^3$ | 15 | 5.0 | 29 | Good | None | None |
| B6 | 6 | 30 | 40 | 5 | 500 | 0.02 | $10^3$ | 15 | 5.0 | 29 | Good | None | None |
| B7 | 7 | 60 | 3 | 1 | 350 | 0.07 | $10^3$ | 15 | 5.0 | 29 | Good | None | None |
| B8 | 8 | 60 | 3 | 5 | 350 | 0.07 | $10^3$ | 15 | 5.0 | 29 | Good | None | None |
| B9 | 9 | 60 | 40 | 1 | 350 | 0.07 | $10^3$ | 15 | 5.0 | 29 | Good | None | None |
| B10 | 10 | 60 | 40 | 5 | 350 | 0.07 | $10^3$ | 15 | 5.0 | 29 | Good | None | None |
| B11 | 11 | 60 | 50 | 5 | 150 | 0.03 | $10^2$ | 5 | 3.0 | 5 | Good | None | None |
| B12 | 12 | 30 | 3 | 5 | 150 | 0.20 | $10^8$ | 30 | 8.0 | 40 | Good | None | None |
| B13 | 13 | 25 | 15 | 3 | 550 | 0.01 | $10^3$ | 15 | 5.0 | 29 | Not Good | 10000 | A |
| B14 | 14 | 65 | 15 | 3 | 300 | 0.10 | $10^3$ | 15 | 5.0 | 29 | Good | 5000 | A |
| B15 | 15 | 50 | 2 | 3 | 300 | 0.07 | $10^3$ | 15 | 5.0 | 29 | Good | 12000 | A |
| B16 | 16 | 50 | 55 | 3 | 300 | 0.07 | $10^3$ | 15 | 5.0 | 29 | Good | 7000 | B |

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A cleaning roller for removing foreign matters from a toner image bearing member having a peripheral surface thereof for bearing a toner image, comprising:

a core; and a polyurethane foam layer made of polyurethane foam and covering the core to form a peripheral surface of the cleaning roller adapted to be in contact with the peripheral surface of the toner image bearing member, the polyurethane foam being designed so that the number of cells per inch thereof is 30 or more and 60 or less and an open ratio of cell walls thereof is 3% or more and 50% or less.

2. The cleaning roller of claim 1, wherein a hardness of the polyurethane foam is 1 gf/mm or more and 5 gf/mm or less, the hardness being defined by a load per unit length in a longitudinal direction of the roller, the load being determined by forcing a peripheral surface of the polyurethane foam against a substrate, measuring a load necessary for the polyurethane foam layer to be compressed by 30% in thickness, and dividing the load by a length of the polyurethane foam layer in the longitudinal direction.

3. The cleaning roller of claim 1, wherein an average diameter of cells of the polyurethane foam is 150 μm or more and 500 μm or less.

4. The cleaning roller of claim 1, wherein a density of the polyurethane foam is 0.03 g/cm$^3$ or more and 0.2 g/cm$^3$ or less.

5. The cleaning roller of claim 1, wherein a volume resistance of the polyurethane foam is $10^2$ Ωcm or more and $10^6$ Ωcm or less.

6. The cleaning roller of claim 1, wherein the polyurethane foam is manufactured by mixing polyol, isocyanate, foaming gas, and foaming agent for producing foams by a chemical reaction with the isocyanate.

7. An image forming apparatus, comprising:

at least one electrostatic latent image bearing member for bearing an electrostatic latent image formed thereon, the electrostatic latent image being visualized with a toner into a toner image;

a transfer member having an endless peripheral surface for receiving the toner image from the electrostatic latent image bearing member and then transferring the toner image onto a recording medium; and a cleaning roller disposed in contact with the peripheral surface of the transfer member to define a contact region therebetween for removing a residual toner which remains on the peripheral surface of the transfer member after a transfer of the toner image from the transfer member to the recording medium, the cleaning roller having a core and a polyurethane foam layer made of polyurethane foam and covering the core to form a peripheral surface of the roller in contact with the peripheral surface of the transfer member, the polyurethane foam being designed so that the number of cell per inch thereof is 30 or more and 60 or less and an open ratio of cell walls thereof is 3% or more and 50% or less.

8. The image forming apparatus of claim 7, wherein a contact force at the contact region between the peripheral surfaces of the transfer member and the cleaning roller is 5N/m or more and 30N/m or less.

9. The image forming apparatus of claim 7, wherein an amount of maximum compression of the polyurethane foam layer at the contact region is 5% or more and 40% or less of a thickness of the polyurethane form layer and a contact length in a peripheral direction of the cleaning roller between the peripheral surfaces of the transfer member and the cleaning roller is 3 mm or more and 8 mm or less.

10. The image forming apparatus of claim 7, further comprising a scraping member disposed in contact with the peripheral surface of the cleaning roller for scraping off foreign matters therefrom.

11. The image forming apparatus of claim 7, further comprising a cleaning member disposed in contact with the peripheral surface of the transfer member for cleaning the peripheral surface of the transfer member.

12. The image forming apparatus of claim 7, wherein portions of the peripheral surfaces of the transfer member and the cleaning roller in the contact region thereof move in opposite directions.

13. The image forming apparatus of claim 7, wherein a hardness of the polyurethane foam is 1 gf/mm or more and 5 gf/mm or less, the hardness being defined by a load per unit length in a longitudinal direction of the roller, the load being determined by forcing a peripheral surface of the polyurethane foam against a substrate, measuring a load necessary for the polyurethane foam layer to be compressed by 30% in thickness, and dividing the load by a length of the polyurethane foam layer in the longitudinal direction.

14. The image forming apparatus of claim 7, wherein an average diameter of cells of the polyurethane foam is 150 μm or more and 500 μm or less.

15. The image forming apparatus of claim 7, wherein a density of the polyurethane foam is 0.03 g/cm$^3$ or more and 0.2 g/cm$^3$ or less.

16. The image forming apparatus of claim 7, wherein a volume resistance of the polyurethane foam is $10^2$ Ωcm or more and $10^6$ Ωcm or less.

17. The image forming apparatus of claim 7, wherein the polyurethane foam is manufactured by mixing polyol, isocyanate, foaming gas, and foaming agent for producing foams by a chemical reaction with the isocyanate.

* * * * *